US007042437B2

(12) United States Patent
Tai et al.

(10) Patent No.: US 7,042,437 B2
(45) Date of Patent: May 9, 2006

(54) METHOD AND CIRCUIT FOR DRIVING LIQUID CRYSTAL DISPLAY

(75) Inventors: Ya-Hsiang Tai, Hsinchu (TW); Chaug-Ming Chiu, Taoyuan (TW)

(73) Assignee: Toppoly Optoelectronics Corp., Chun-Nan (TW)

( * ) Notice: Subject to any disclaimer, the term of this patent is extended or adjusted under 35 U.S.C. 154(b) by 488 days.

(21) Appl. No.: 10/460,440

(22) Filed: Jun. 12, 2003

(65) Prior Publication Data

US 2004/0145555 A1 Jul. 29, 2004

(30) Foreign Application Priority Data

Jan. 27, 2003 (TW) ..... 92101680 A

(51) Int. Cl.
*G09G 3/36* (2006.01)

(52) U.S. Cl. ..... 345/103; 345/96

(58) Field of Classification Search ..... 345/87, 345/96, 103, 209
See application file for complete search history.

(56) References Cited

U.S. PATENT DOCUMENTS

| | | | | |
|---|---|---|---|---|
| 6,496,172 | B1 * | 12/2002 | Hirakata | 345/96 |
| 2001/0015716 | A1 * | 8/2001 | Kim | 345/96 |
| 2002/0005846 | A1 * | 1/2002 | Hiroki et al. | 345/204 |
| 2003/0043105 | A1 * | 3/2003 | Hirakata | 345/96 |
| 2003/0057857 | A1 * | 3/2003 | Saito et al. | 315/169.3 |

* cited by examiner

*Primary Examiner*—Ricardo Osorio
(74) *Attorney, Agent, or Firm*—Quintero Law Office

(57) ABSTRACT

A driving method of an LCD panel having a plurality of display groups comprising a plurality of display cells and respectively coupled to a data electrode and a gate electrode. The display cells of the display group are coupled to the data electrode and the gate electrode connected to the display group. The video signals are provided to the data electrodes to make the number of the display groups having the number of the display cells with positive polarity greater than the number of the display cells with negative polarity equal to the number of the display groups having the number of the display cells with negative polarity greater than the number of the display cells with positive polarity. The display groups are coupled to the same gate electrode. Then, the scan signals are provided to the gate electrodes.

10 Claims, 5 Drawing Sheets

METHOD AND CIRCUIT FOR DRIVING LIQUID CRYSTAL DISPLAY

BACKGROUND OF THE INVENTION

1. Field of the Invention

The present invention relates in general to a method and a circuit for driving a liquid crystal display (LCD). In particular, the present invention relates to a method for driving an LCD having display cells in the same row sharing a data electrode to eliminate cross talk and improve image appearance.

2. Description of the Related Art

FIG. 1 is a schematic diagram of a prior art liquid crystal display panel (hereinafter, referred to as an "LCD panel") and the peripheral driving circuits thereof. As shown in the figure, an LCD panel 1 is formed by interlacing data electrodes (represented by D1, D2, D3, . . . , Dm) and gate electrodes (represented by G1, G2, G3, . . . , Gm), each of the interlacing data electrodes and gate electrodes controlling a display cell. As an example, interlacing data electrode D1 and gate electrode G1 control the display cell 200. The equivalent circuit of each display cell comprises thin film transistors (TFTS) (Q11–Q1m, Q21–Q2m , . . . , Qn1–Qnm) and storage capacitors (C11–C1m, C21–C2m , . . . , Cn1–Cnm). The gates and drains of these TFTs are respectively connected to gate electrodes (G1–Gn) and data electrodes (D1–Dm). Such a connection can turn on/off all TFTs on the same line (i.e. positioned on the same scan line) using a scan signal of gate electrodes (G1–Gn), thereby controlling the video signals of the data electrodes to be written into the corresponding display cell. It is noted that a display cell only controls the brightness of a single pixel on the LCD panel.

Accordingly, each display cell responds to a single pixel on a monochromatic LCD while each display cell responds to a single subpixel on a color LCD. The subpixel can be red (represented by "R"), blue (represented by "B"), or green (represented by "G"). In other words, a single pixel is formed by an RGB (three display cells) combination.

In addition, FIG. 1 also shows a part of the driving circuit of the LCD panel 1. The gate driver 10 outputs one or more scan signals (also referred to as scan pulses) of each of the gate electrodes G1, G2, . . . , Gn according to a predetermined sequence. When a scan signal is carried on one gate electrode, the TFTs within all display cells on the same row or scan line are turned on while the TFTs within all display cells on other rows or scan lines may be turned off. When a scan line is selected, data driver 20 outputs a video signal (gray value) to the m display cells of the respective rows through data electrodes D1, D2, . . . , Dm according to the image data to be displayed. After gate driver 10 scans n rows continuously, the display of a single frame is completed. Thus, repeated scans of each scan line can achieve the purpose of continuously displaying an image. As shown in FIG. 1, signal CPV indicates the clock of the gate driver 10, signal CTR indicates the scan control signal received by the gate driver 10, signal LD indicates a data latch signal of the data driver 20, and signal DATA indicates the image signal received by the data driver 20.

Typically, a video signal, which is transferred by the data electrodes D1, D2, . . . , Dm, is divided into a positive video signal and a negative video signal based on the relationship with the common electrode voltage VCOM. The positive video signal indicates a signal having a voltage level higher than the voltage VCOM, and based on the gray value represented, the actual produced potential of the signal ranges between voltages Vp1 and Vp2. FIG. 2 shows the relationship between the common electrode voltage VCOM and the voltages VP1, Vp2, Vn1 and Vn2. In general, a gray value is lower if it is closer to the common electrode voltage VCOM. On the other hand, the negative video signal indicates that the signal has a voltage level lower than the voltage VCOM, and based on the gray value represented, the actual produced potential of the signal ranges between voltages Vn1 and Vn2. Also, the gray value is lower if it is closer to the common electrode voltage VCOM. When a gray value is represented, whether in a positive or negative video signal, the display effect is substantially the same.

In order to prevent the liquid crystal molecule from continuously receiving a single-polar bias voltage, thus reducing the life span of liquid crystal molecules, a display cell alternately receives positive and negative polar video signals corresponding to odd and even frames.

The disposition of the different polar video signal in each display cell can be divided into four driving types: frame inversion, line inversion, column inversion, and dot inversion. In the frame inversion driving mode, the polarity of the video signal is the same on the same frame but opposite to its adjacent frames. In the line or column inversion driving modes, the same line or column on the same frame has the same polarity of the video signal but the opposite polarity to its adjacent lines or columns. In the dot inversion driving mode, the polarity of the video signal on the same frame is presented in an interlaced form, which is the type described in the present invention.

FIG. 3 shows the polarity of the video signals received by each display cell on the LCD panel 3 in dot inversion driving mode. In FIG. 3, the LCD panel 3 comprises a plurality of display cells. The display cells responding to the same gate electrode are connected to different data electrodes, respectively. In dot inversion driving mode, the polarity of each display cell opposite to its adjacent display cells connected to the same gate electrode or data electrode in a frame.

As mentioned above, when a gray value is represented, whether in a positive or negative video signal, the display effect is substantially the same. In addition, the number of the positive video signals and negative video signals received by a data electrode is the same. Thus, the common electrode voltage VCOM is not obviously shifted.

FIG. 4 shows the polarity of the video signals received by each display cell on the LCD panel 3 in dot inversion driving mode when a plurality of display cells in one row sharing a single data electrode. The number of the data electrodes is decreased when there are some display cells in one row sharing a single data electrode. Thus, the area of the data electrode is also decreased. In dot inversion driving mode, when there are n display cells in the same row sharing one data electrode, the data electrode D0 drives the first display cell, and then the data electrode D1 drives the (n+1)th display cell in opposite polarity. After the data electrode Dm driving the (mn+1)th display cell, the data electrode D0 drives the second display cell and then the data electrode D1 drives the (n+2)th display cell in opposite polarity. Here, the display cells in the same row sharing one data electrode comprise a display group. However, the common electrode voltage VCOM is shifted by electric coupling.

Although the driving method shown in FIG. 4 sequentially drives display cells in opposite polarity, the adjusted display cells are not driven in sequence because the driving method is changed. Thus, in a display group, the number of the display cells with positive polarity may be different than the display cells with negative polarity. Therefore, the common electrode voltage VCOM is from shifting by coupling and the gray levels of the display cells are incorrect. As shown in FIG. 4, all the display cells in a display group have the same polarity. Thus, the common electrode voltage VCOM is shifted by electric coupling.

SUMMARY OF THE INVENTION

The object of the present invention is thus to provide a method and a circuit for driving an LCD having the display cells sharing the data electrode in the same row to prevent the common electrode voltage VCOM from shifting by coupling.

To achieve the above-mentioned object, the present invention provides a driving method for an LCD panel having a plurality of display groups comprising a plurality of display cells and respectively coupled to a data electrode and a gate electrode. The display cells of the display group are coupled to the data electrode and the gate electrode connected to the display group. The video signals are provided to the data electrodes to make the number of the display groups having the number of the display cells with positive polarity greater than the number of the display cells with negative polarity equal to the number of the display groups having the number of the display cells with negative polarity greater than the number of the display cells with positive polarity. The display groups are coupled to the same gate electrode. Then, the scan signals are provided to the gate electrodes.

BRIEF DESCRIPTION OF THE DRAWINGS

The present invention will become more fully understood from the detailed description given hereinbelow and the accompanying drawings, given by way of illustration only and thus not intended to be limitative of the present invention.

DETAILED DESCRIPTION OF THE INVENTION

Figure 1:
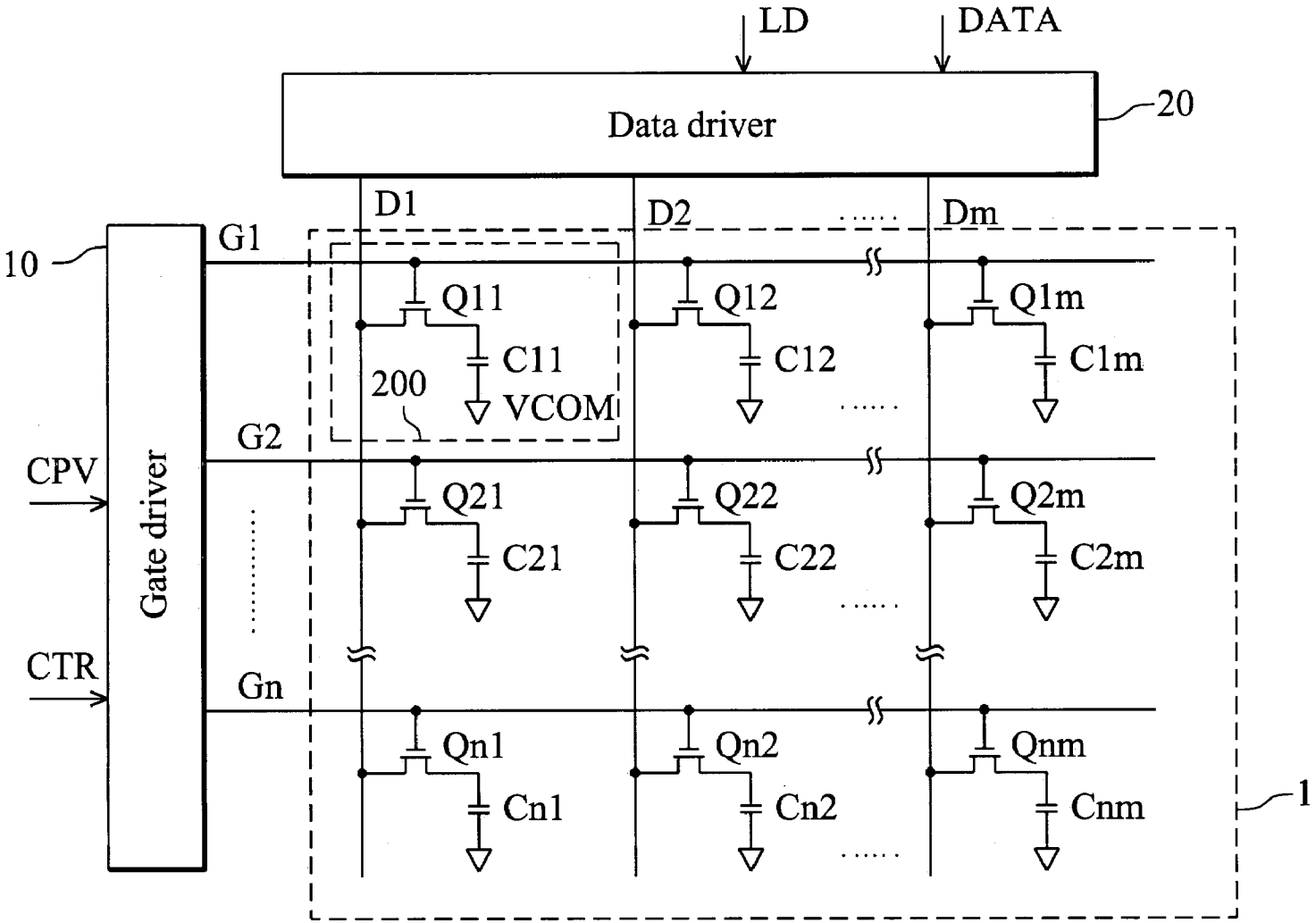
FIG. 1 (PRIOR ART)
FIG. 1 is a schematic diagram of a conventional LCD panel and the peripheral driving circuits thereof.
Figure 2:
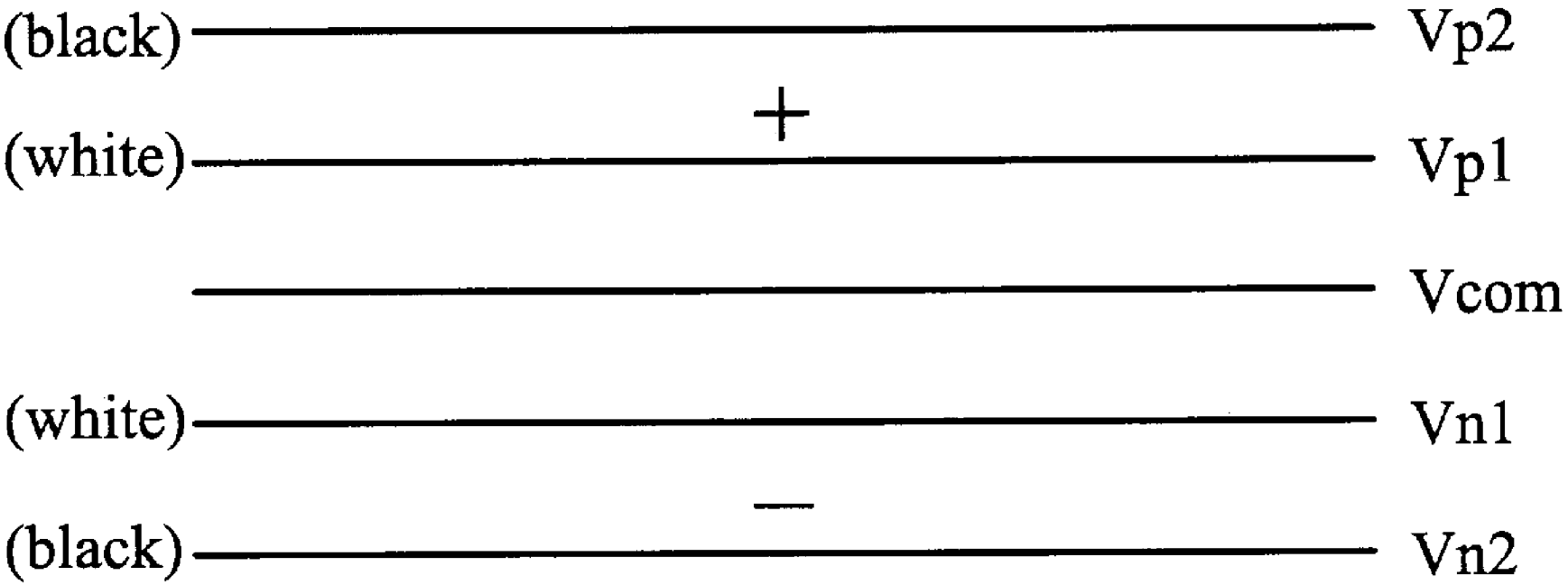
FIG. 2 (PRIOR ART)
FIG. 2 shows the relationship between the common electrode voltage VCOM and the voltages VP1, Vp2, Vn1 and Vn2.
Figure 3:
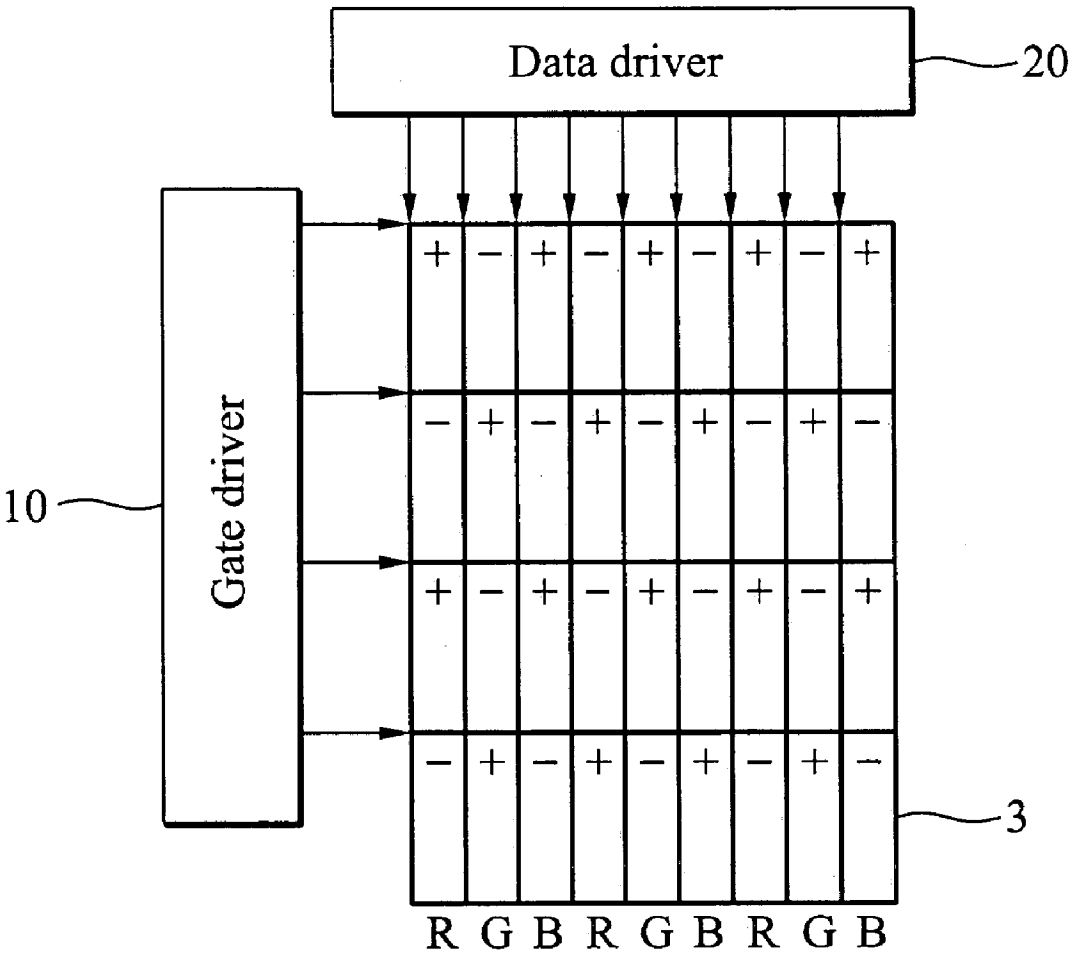
FIG. 3 shows the polarity of the video signals received by each display cell on the LCD panel 3 in dot inversion driving mode.
Figure 4:
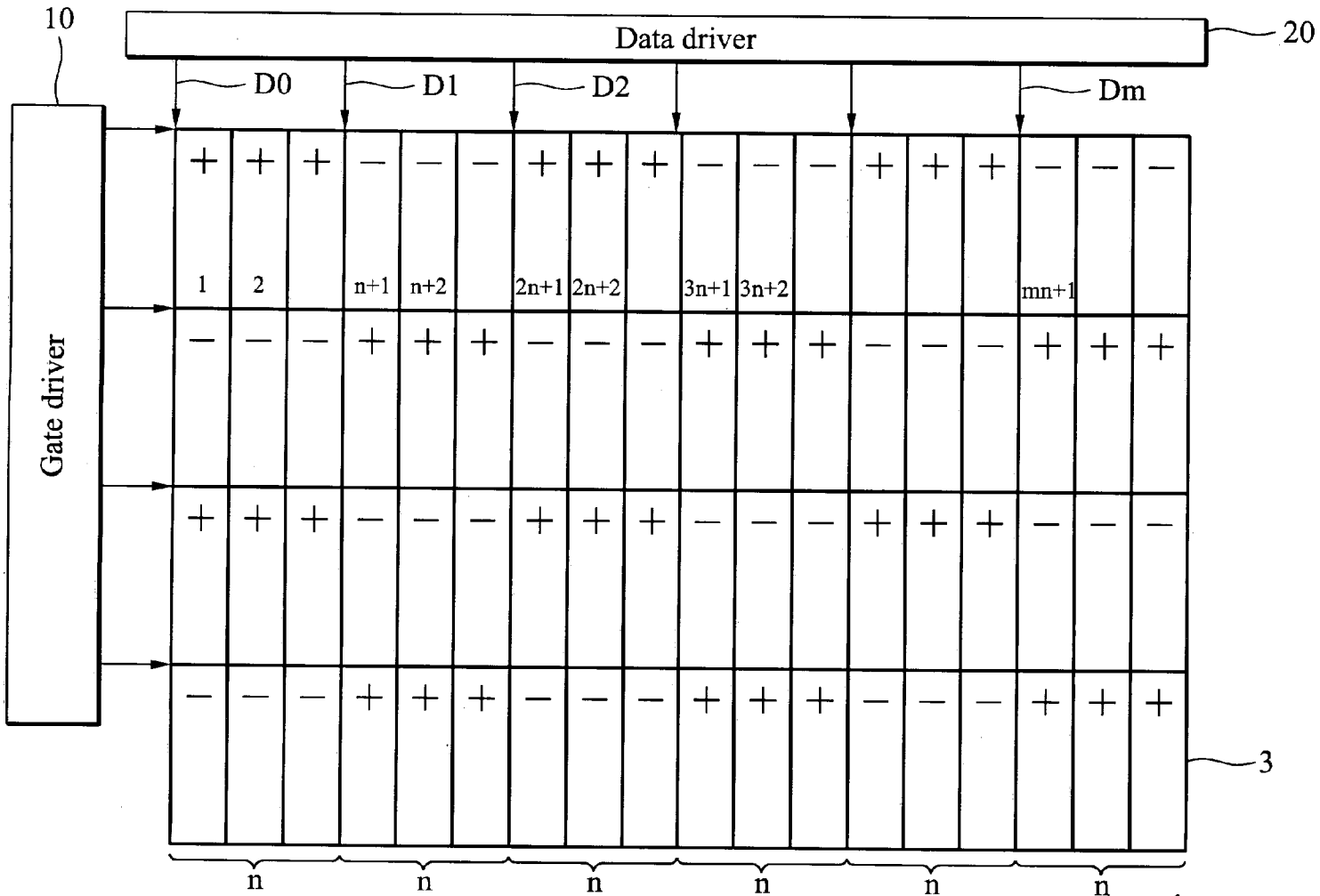
FIG. 4 (PRIOR ART)
FIG. 4 shows the polarity of the video signals received by each display cell on the LCD panel 3 in dot inversion driving mode when a plurality of display cells in one row share a single data electrode.
Figure 5:
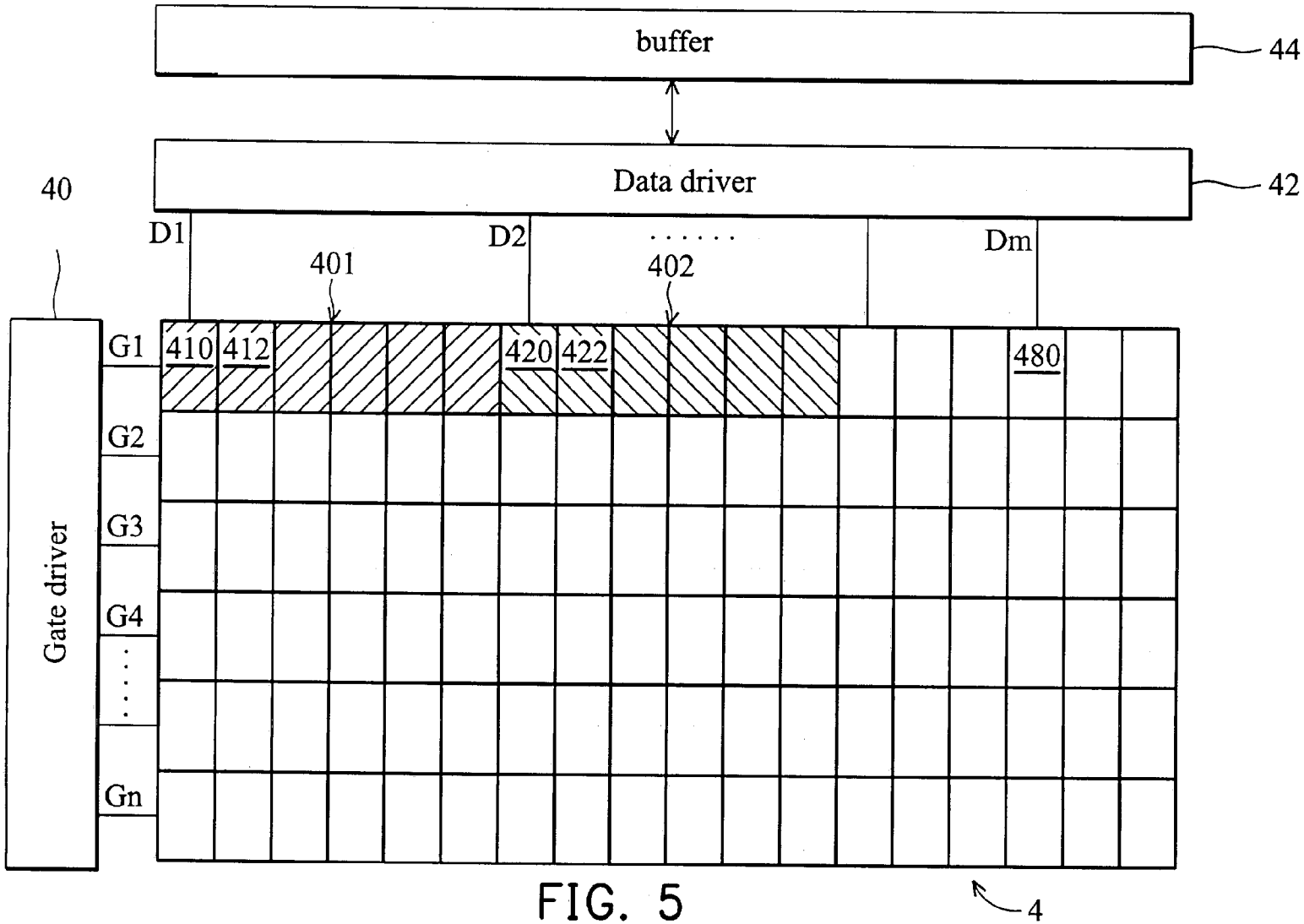
FIG. 5 is a schematic diagram of the LCD panel and the peripheral driving circuits thereof according to the embodiment of the present invention.

FIG. 5 is a schematic diagram of the LCD panel and the peripheral driving circuits thereof according to the embodiment of the present invention. As shown in the figure, an LCD panel 4 is formed by interlacing data electrodes (represented by D1, D2, D3, . . . , Dm) and gate electrodes (represented by G1, G2, G3, . . . , Gm), each of the interlacing data electrodes and gate electrodes controlling a display group. For example, interlacing data electrode D1 and gate electrode G1 to control the display group 401 and interlacing data electrode D2 and gate electrode G1 to control the display group 402. Here, each display group comprises a plurality of display cells. The equivalent circuit of each display cell comprises thin film transistors (TFTs) (Q11–Q1m , Q21–Q2m , . . . , Qn1–Qnm) and storage capacitors (C11–C1m, C21–C2m , . . . , Cn1–Cnm). The gates and drains of these TFTs are respectively connected to gate electrodes (G1–Gn) and data electrodes (D1–Dm). Such a connection can turn on/off all TFTs on the same line (i.e. positioned on the same scan line) using a scan signal of gate electrodes (G1–Gn), thereby controlling the video signals of the data electrodes to be written into the corresponding display cell.

The gate driver 40 outputs one or more scan signals (also referred to as scan pulses) of each of the gate electrodes G1, G2, . . . , Gn according to a predetermined sequence. When a scan signal is carried on one gate electrode, the TFTs within all display cells on the same row or scan line are turned on while the TFTs within all display cells on other rows or scan lines may be turned off. When a scan line is selected, data driver 42 outputs a video signal (gray value) to the m display groups of the respective rows through data electrodes D1, D2, . . . , Dm according to the image data to be displayed. After the data electrode D1 outputs a video signal to the display cell 410 of the display group 401, the data electrode D2 outputs another video signal to the display cell 420 of the display group 402. In addition, after the data electrode Dm outputting the video signal to the display cell 480, the data electrode D1 outputs the video signal to the display cell 412, and then the data electrode D2 outputs the video signal to the display cell 422. The cell driving of one row is completed when all the display cells coupled to the corresponding gate electrode receive the video signals, respectively. After the gate driver 40 scans n rows continuously, the display of a single frame is completed. Thus, repeated scans of each scan line can achieve the purpose of continuously displaying an image.

According to the present invention, the polarities of the display cells are pre-recoded in a data buffer 44, and the data driver 42 provides the video signal having the pre-recoded polarity to the corresponding data electrode.

The setting rule of the pre-recoded polarity of each display cell is decreased. The number of the display cells with positive polarity and with negative polarity in a display group is the same when the display group comprises an even number of display cells. In addition, the polarity of each display cell is opposite that of the directly connected display cells in a frame. Thus, the influence of the common electrode voltage VCOM by the video signals of the display cells is counteracted to prevent the common electrode voltage VCOM from shifting by coupling and causing cross talk.

When the display group comprises odd display cells, the total polarity of the display group is opposite that of the directly connected display groups in a frame. Here, the total polarity of a display group is positive when the number of the display cells with positive polarity is greater than the display cells with negative polarity. Contrarily, the total polarity of a display group is negative when the number of the display cells with positive polarity is less than the display cells with negative polarity. In general, the difference between the number of the display cells with positive polarity and the number of the display cells with negative polarity is one, thus, the influence of the common electrode voltage VCOM by the video signals of the display groups is counteracted to prevent the common electrode voltage VCOM from shifting by coupling and causing cross talk.

Accordingly, the method and the circuit for driving an LCD having the display cells sharing the data electrode in the same row of the present invention prevent the common electrode voltage VCOM shifted by electric coupling and causing cross talk between each display cell.

The foregoing description of the preferred embodiments of this invention has been presented for purposes of illustration and description. Obvious modifications or variations are possible in light of the above teaching. The embodiments were chosen and described to provide the best illustration of the principles of this invention and its practical application to thereby enable those skilled in the art to utilize the invention in various embodiments and with various modifications as are suited to the particular use contemplated. All such modifications and variations are within the scope of the present invention as determined by the appended claims when interpreted in accordance with the breadth to which they are fairly, legally, and equitably entitled.

What is claimed is:

1. A driving method of an LCD panel having a plurality of display groups comprising a plurality of display cells and respectively coupled to a data electrode and a gate electrode, the display cells of the display group coupled to the data electrode and the gate electrode connected to the display group, comprising the following steps:

providing video signals to the data electrodes to make the number of the display groups having the number of the display cells with positive polarity greater than the number of the display cells with negative polarity equal to the number of the display groups having the number of the display cells with negative polarity greater than the number of the display cells with positive polarity, wherein the display groups are coupled to the same gate electrode; and providing scan signals to the gate electrodes.

2. The driving method as claimed in claim 1, wherein the polarity of any display cell is opposite that of the display cells directly adjacent thereto.

3. The driving method as claimed in claim 1, wherein the total polarity of the display group is opposite that of the directly connected display groups.

4. The driving method as claimed in claim 3, wherein the total polarity of the display group is positive when the number of the display cells with positive polarity is greater than the display cells with negative polarity.

5. The driving method as claimed in claim 3, wherein the total polarity of the display group is negative when the number of the display cells with positive polarity is smaller than the display cells with negative polarity.

6. A driving circuit of an LCD panel having a plurality of display groups comprising a plurality of display cells and respectively coupled to a data electrode and a gate electrode, the display cells of the display group coupled to the data electrode and the gate electrode connected to the display group, comprising:

a gate driver for providing scan signals to the gate electrodes;

a buffer for recording video signals making the number of the display groups having the number of the display cells with positive polarity greater than the number of the display cells with negative polarity equal to the number of the display groups having the number of the display cells with negative polarity greater than the number of the display cells with positive polarity, wherein the display groups are coupled to the same gate electrode; and a data driver for providing the video signals to the data electrodes.

7. The driving circuit as claimed in claim 6, wherein the polarity of any display cell is opposite that of the display cells directly adjacent thereto.

8. The driving circuit as claimed in claim 6, wherein the total polarity of the display group is opposite that of the directly connected display groups.

9. The driving circuit as claimed in claim 8, wherein the total polarity of the display group is positive when the number of the display cells with positive polarity is greater than the display cells with negative polarity.

10. The driving circuit as claimed in claim 8, wherein the total polarity of the display group is opposite that of the directly connected display groups.

* * * * *